United States Patent [19]

Yang

[11] Patent Number: 4,633,741

[45] Date of Patent: Jan. 6, 1987

[54] HAMMERING TOOL WITH FLEXIBLE HANDLE

[76] Inventor: Tai-Her Yang, 5-1 Taipin St., Si-Hu Town, Dzan-Hwa, Taiwan

[21] Appl. No.: 749,097

[22] Filed: Jun. 26, 1985

Related U.S. Application Data

[63] Continuation-in-part of Ser. No. 544,260, Oct. 21, 1983, abandoned.

[51] Int. Cl.[4] ..... B25C 1/00

[52] U.S. Cl. ..... 81/20; 81/19

[58] Field of Search ..... 81/20, 19

[56] References Cited

U.S. PATENT DOCUMENTS

| | | | |
|---|---|---|---|
| 587,154 | 7/1897 | Minnemeyer | 81/20 |
| 967,703 | 8/1910 | Bagnall | 81/20 |
| 1,194,170 | 8/1916 | Grossman | 81/20 |
| 2,467,284 | 4/1949 | Williams | 81/20 |
| 2,809,684 | 10/1957 | Lyon | 81/20 |
| 3,393,720 | 7/1968 | Fenlin | 81/20 |

*Primary Examiner*—Frederick R. Schmidt
*Assistant Examiner*—Joseph T. Zatarga
*Attorney, Agent, or Firm*—Leonard Bloom

[57] ABSTRACT

A hammer has a pair of substantially-parallel relatively-thin plate springs secured between the striking head of the hammer and its gripping handle. The respective plate springs are provided with longitudinal ribs (preferably outwardly curved in cross-section) to provide the desired stiffness, while assuring sufficient flexibility and preventing undue shocks and vibrations from being experienced by the user during extended use of the hammer. In lieu of plate springs, a U-shaped rod may be used.

10 Claims, 13 Drawing Figures

Fig. 4
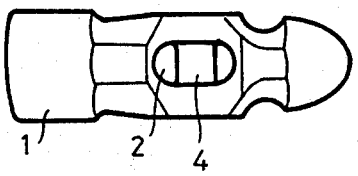
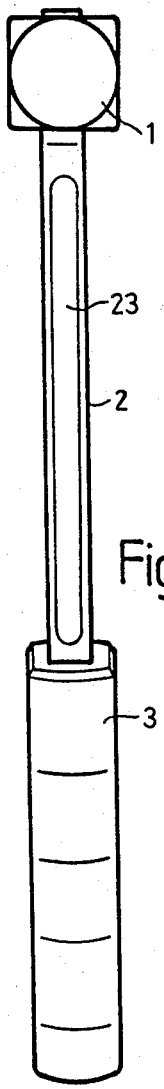
Fig. 3
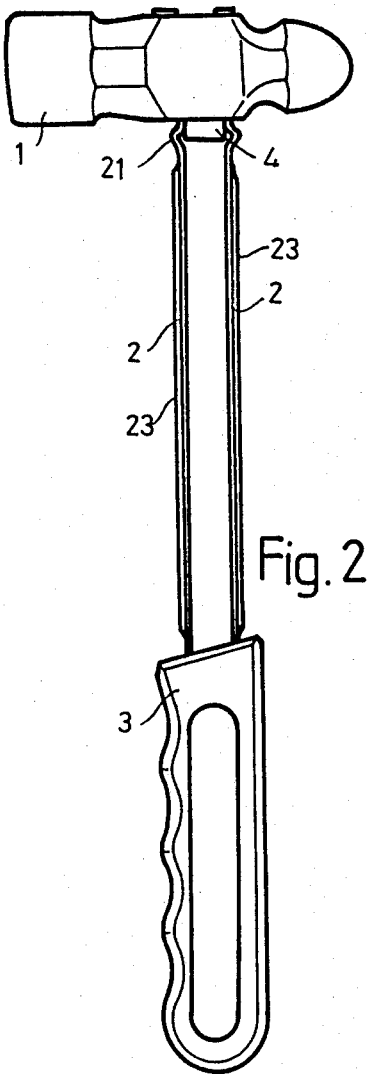
Fig. 2

HAMMERING TOOL WITH FLEXIBLE HANDLE

CROSS-REFERENCE TO RELATED APPLICATION

This application is a continuation-in-part of application for U.S. Pat. Ser. No. 544,260 filed 10/21/83, now abandoned.

BACKGROUND OF THE INVENTION

The inventor is aware of the following prior patents relating to the hammering tool of the present invention:

A. U.S. Pat. No. 2,809,684, which discloses a plate spring, one end of which is connected to the hammering block, and the other end of which is connected to a grip handle. However, the single plate spring is a rectangular flat piece, so under the shocks resulting from the impacts during normal use of the tool, the hammering block will tend to slide back towards the grip handle. Furthermore, after being used for a certain time, this single plate spring will, due to its insufficient stiffness, tend to become deformed, thus making its further use relatively impractical.

B. U.S. Pat. No. 1,177,472, in which the gripping handle and an axe blade are flexibly joined. However, the flexible connection plates are similar to that disclosed in the '684 patent noted above, hence its inadequate rigidity may become troublesome.

C. U.S. Pat. No. 4,331,193, in which a plate spring is implanted in the gripping handle of the hammering tool, and in which the end of the spring is joined to a hammering block. This design may provide the hammering tool with some flexibility; however, its structure is more complicated and its utilization is more difficult and also uneconomic.

Other prior art, of which I am aware, is as follows: U.S. Pat. Nos. 587,154; 967,703; 1,194,170; 2,467,284; and 3,393,720.

SUMMARY OF THE INVENTION

The structure of the present invention, as disclosed and claimed herein, alleviates the disadvantages and disabilities of the prior art and provides a practical hammering tool for reducing impacts and shocks to the user.

BRIEF DESCRIPTION OF THE DRAWINGS

FIG. 2 is a side elevational view thereof.

FIG. 3 is a front elevational view thereof.

FIG. 4 is a top view thereof.

DETAILED DESCRIPTION OF THE INVENTION

Figure 1:
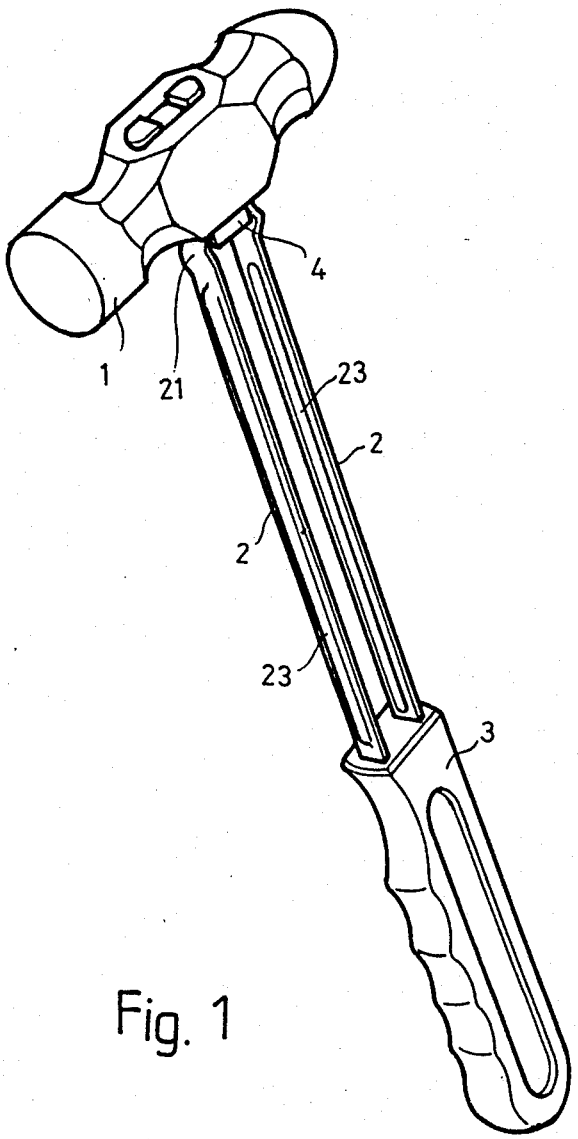
FIG. 1 is an isometric view of one embodiment of the structure of the present invention.

The present invention provides a hammering tool having a flexible handle, wherein means are provided to avoid the hammering block from sliding back on the end of a plate spring that joins the hammering block to the handle, and wherein the cross section of the plate spring has different designs to accommodate its flexible extent.

More of the conventional hammering tools have a wooden grip handle, which does not have good flexibility. When the hammer impacts against the work piece during the hammering work, a counter-shock is thus produced and reacts directly to the user's hand. These shocks may lead to the user's hand becoming numb, painful, hurt or injured. In view of this, the inventor has conducted researches and has provided herein a hammering tool with a flexible handle. The feature of this improved design is that the part between the hammering block of the hammering tool and its gripping handle has a flexible not a stiff material, including a pair of substantially-parallel relatively-thin plate springs, each of which has a longitudinal rib for stiffening purposes, each of the ribs having an outwardly-protruding cross-section. This design improves upon the defects of the conventional hammering tools by providing a practical flexible handle.

The structure of the hammering tool with its flexible handle according to the present invention differs from the above-noted prior art citations and is more practical and superior. The structural design of various embodiments of this invention are described in detail as follows.

As shown in FIGS. 1–4, a hammering block or head 1 is connected to a U-shaped structure including two plate springs 2 which are substantially parallel to one another. The end of each of the two plate springs 2 has a small outwardly-bent section to prevent the hammering block from slipping thereon. The other end of the respective plate springs 2 are connected to a gripping handle 3. The hammering head 1 has a transverse hole or opening; the end of the hole which is closer to the handle is larger, so that the opening has a slight slope or taper and accommodates the respective end portions of the two plate springs 2. A wedge block 4 is closely wedged between the two plate springs 2 to make them stretch toward the respective sides of the opening in the head, thus firmly joining the hammering block 1 to the plate springs 2. The other ends of the two plate springs 2 are implanted in the gripping handle 3 at a proper place (after the hammering block 1 is joined and fixed thereto). The bottom of the head is stopped by the respective protruding arc parts 21 on the plate springs 2. Even though the hammer tool of the present invention is used extensively for a period of time, the hammering block 1 will not slide back towards the gripping handle 3 due to the hammering impulses or shocks, thus ensuring safe use.

Figure 5A:
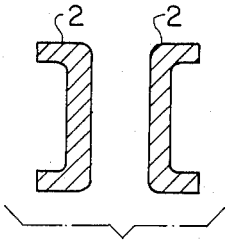
FIGS. 5A–5F illustrate respective cross-sections of the longitudinal stiffening ribs used on the plate-like springs connecting the head to the handle, as shown in FIG. 1.
Figure 5C:
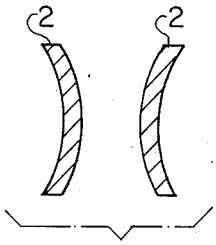
Figure 5E:
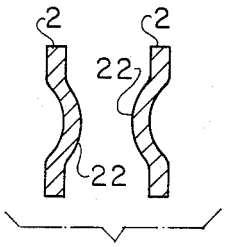
Figure 5B:
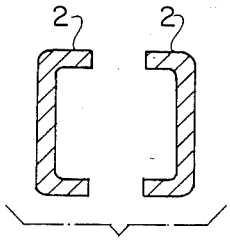
Figure 5D:
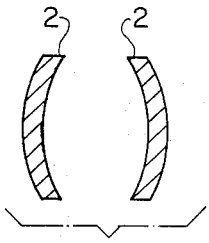
Figure 5F:
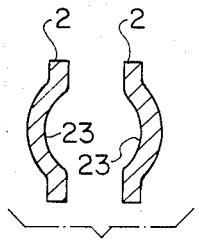

The two plate springs 2 of the U-shaped support, which are joined to the hammering block 1 and to the gripping handle 3, have the desired proper flexibility and sufficient stiffness to avoid deformations produced under the applied forces during use of the hammer tool. These plate springs 2, which are ribbed longitudinally, are not in conventional simple flat plate form. Rather, their cross sectional area in their middle or intermediate longitudinal section are in a variety of different designs as shown in FIG. 5–FIG. 5F. In FIG. 5A, the cross section of the two parallel plate springs 2 is in a mutually opposite U-shaped design; in FIG. 5B, an arc in a mutually-facing U-shaped design; in FIG. 5C, a mutually opposite arc design; in FIG. 5D, a mutually-facing arc design; in FIG. 5E, the central part of the two parallel plate springs 2 has an inwardly-bent arc part (22) provided axially on their mutually-facing inner sides, respectively; and in FIG. 5F, at the central part of the two parallel plate springs 2, an outwardly-bent arc part (23) is provided axially on their mutually-opposite outer sides, respectively. The above cross sectional structures on the middle section of the two parallel plate springs 2 have the expected flexibility and also provide the desired stiffness, thereby increasing its novel and practical functions.

Figures 6, 6A:
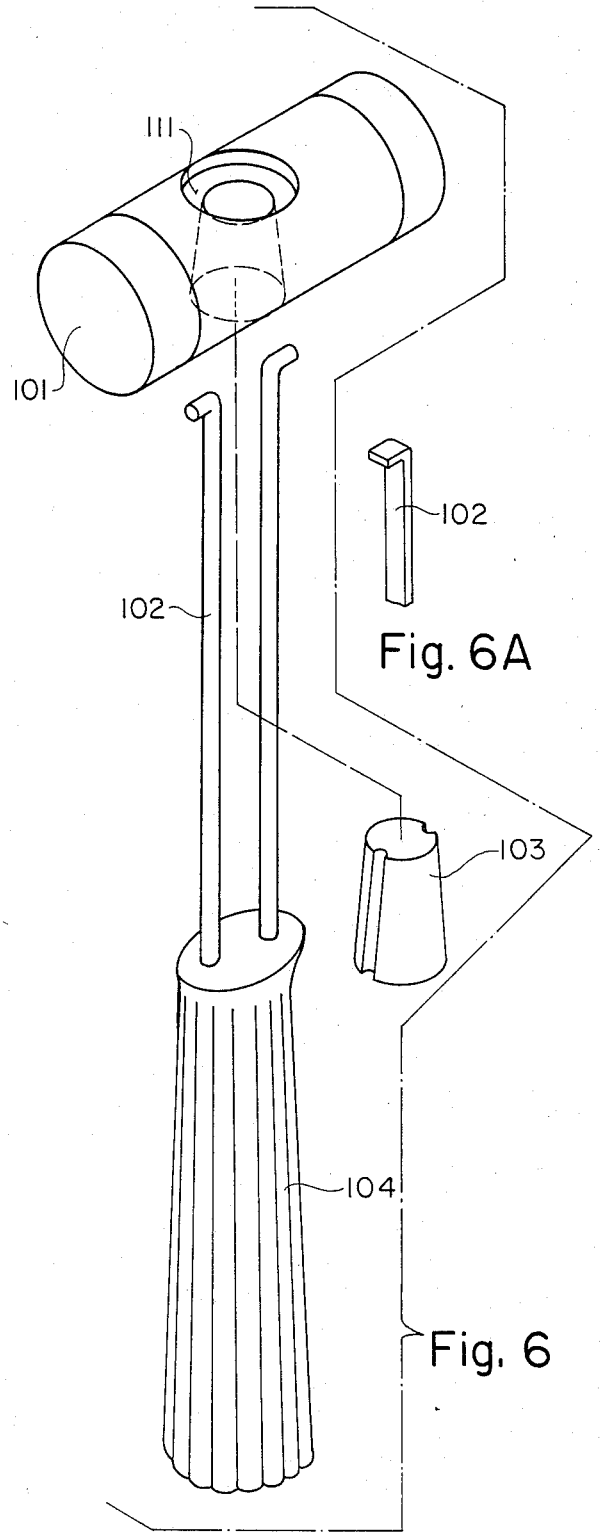
FIG. 6 is an exploded isometric view of a further embodiment of the present invention.
FIG. 6A illustrates an alternate portion of FIG. 6.
Figure 7:
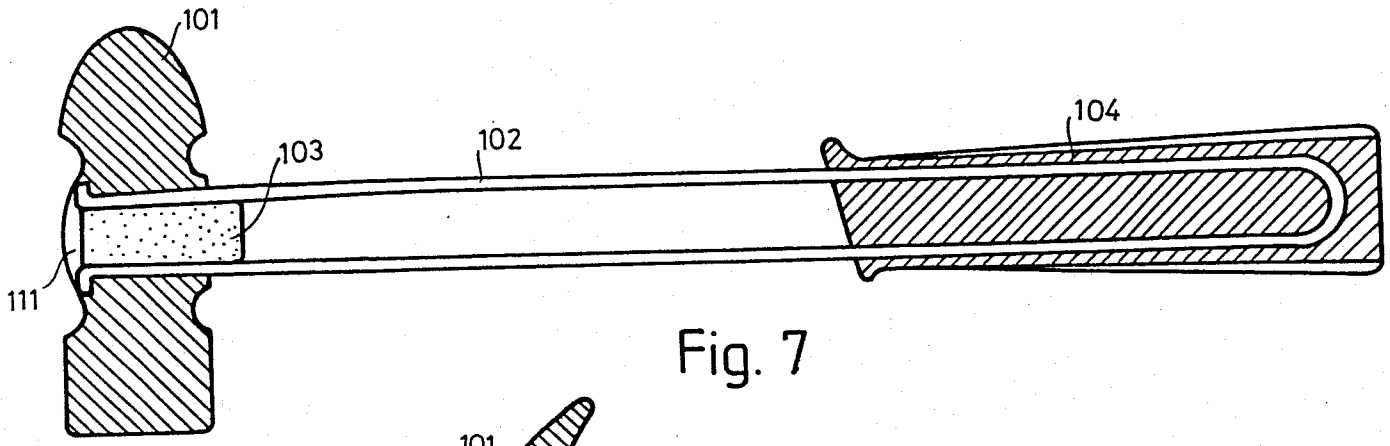
FIG. 7 is a longitudinal sectional view thereof.
Figure 8:
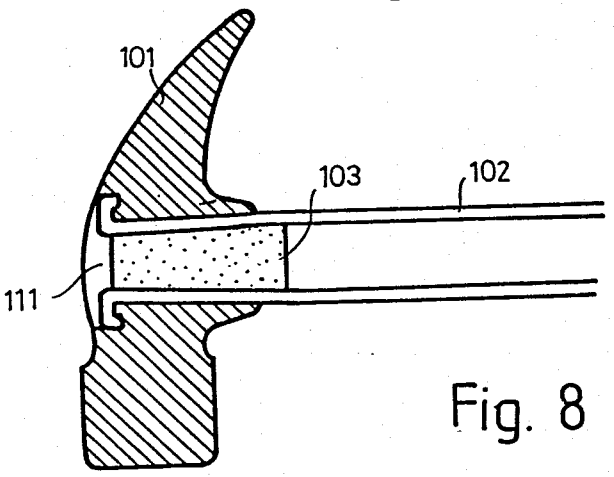
FIG. 8 corresponds substantially to a portion of FIG. 7, but shows a different hammer block.

With reference to FIG. 6, the hammer block 101 is joined to a U-shaped flexible handle 102, fixing plug or wedge 103, and a hand grip 104. The hammer block 101 may have a conventional cylindrical shape and may be made of a conventional material. The block 101 has a T-shaped hole 111, and the middle post hole of the T-shaped hole 111 is a tapered hole that slightly expands towards the grip 104. The U-shaped flexible member is formed by bending a post-shaped or plate-shaped high flexural or excellent flexible material. After the material is bent, the opposite distance between its open ends is larger than or equal to the maximum outer diameter of the middle post hole of the T-shaped hole 111. Further, a small section of each of two terminals of the open ends are bent outward 90° (or more than 90°) or bent in two stages. After the U-shaped handle member 102 is retracted back and extends from the rear side of the hammer block 101 via the T-shaped hole 111, the bent parts of the two terminals of the open ends are placed in a larger diameter hole (or counterbore) in the front end of the T-shaped hole 111 as shown more clearly in FIGS. 7 and 8. The part in the large diameter hole of T-shaped hole 111, according to the bent structure of the open ends of the U-shaped flexible member 102, will be in a flat bottom shape, or a bottom ring end face provided with circular, square or conic ring-shaped slots.

The wedge or fixing plug 103 is a high elastic, flexural tapered member having a slope substantially the same as that of the middle post hole of the T-shaped hole 111. Its ring-shaped face is provided with a rough convex and concave structure or ring-shaped tooth-shaped or ratchet-shaped carved patterns. The open ends of the U-shaped flexible handle 102 are pressed to a substantially closed state and also inserted in from the rear end of the T-shaped hole 111 in the head 111, and are then opened again to seize and join with the head or block 101. Thereafter, fixing plug 103 is pressed into the T-shaped hole 111 between the U-shaped flexible handle 102. The two inner sides of the open ends of the post-shaped or plate-shaped flexible handle 102 can also be provided with a rough face, respectively, different from or the same as that on the fixing plug 103, so that the fixing plug 103 may securely be fixed in the T-shaped hole 111 during the striking operations of said hammer tool and, more particularly, the head 101. The deformation and vibrations of the U-shaped flexible handle 102 can be absorbed by the fixing plug 103, thus maintaining a stable coupling as shown more clearly in FIGS. 7 and 13.

Further, the hand grip 104 preferably is made of a common plastic material and covers the U-shaped flexible handle 102 as, for example, by an extrusion forming. The hand grip 104 may directly fill and cover the closing ends of the U-shaped flexible handle 102 to a proper length.

Figure 9:
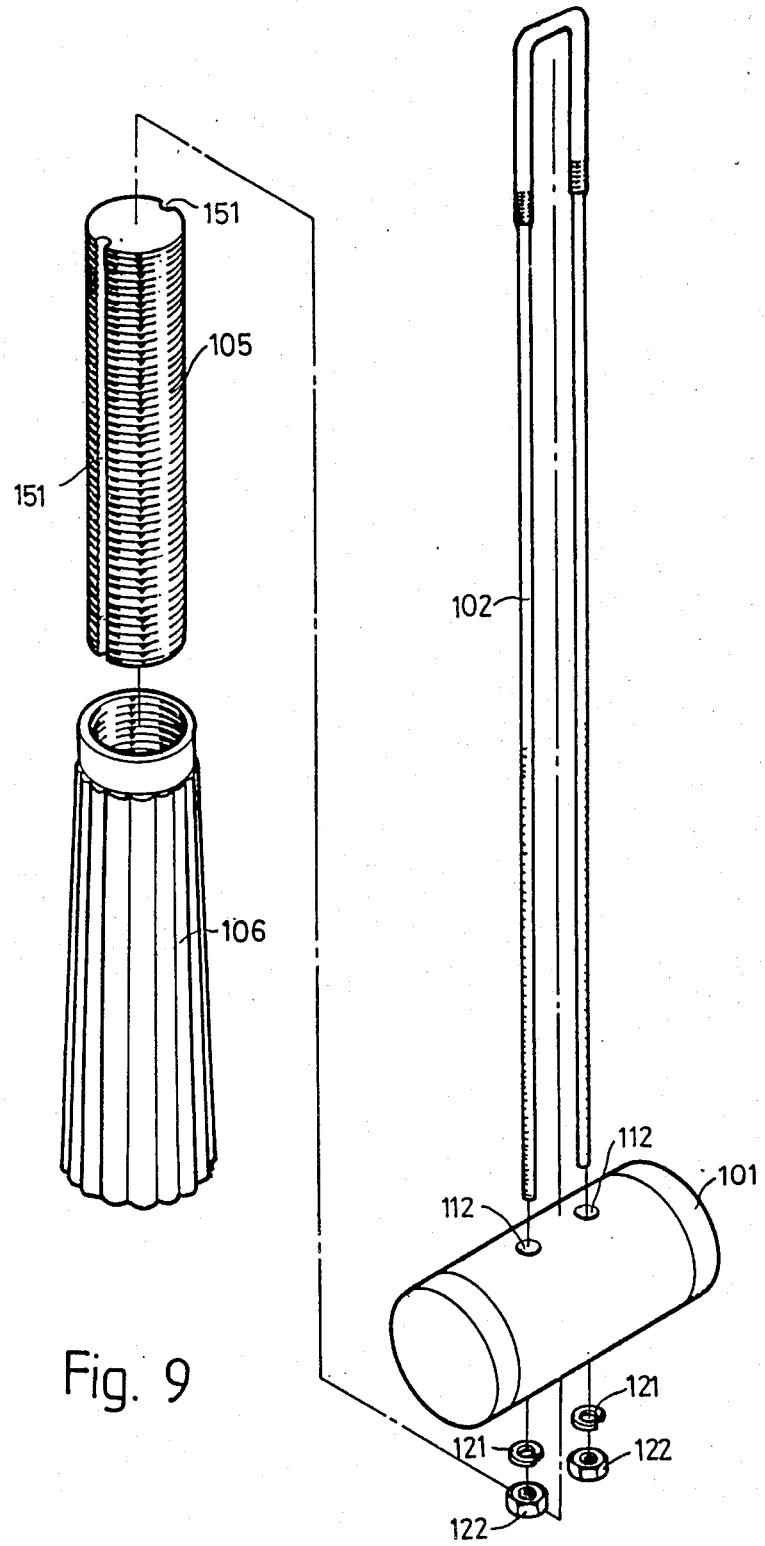
FIG. 9 is an exploded isometric view of a still further embodiment of the present invention.

With reference to FIG. 9, there is illustrated another form of the hammer block 101, U-shaped flexible handle 102, clamp post 105 and hand grip 106. The hammer block or head 101 has two through holes 112 which are provided transversely therein. The open ends of the U-shaped handle 102 are in an upright state, and the front end of the handle 101 passes through these two through holes 112 and then extends from the rear side of these holes to the bent part or bight portion of the U-shaped flexible handle 102 and overlaps over the front end of the two through holes 112. The handle 102 is then fixed by a strong thrust ring or first nuts 122 and washers 121, respectively, on the first threads of the U-shaped flexible handle 102 that extends out of the rear end of the hammer block 101 or head, thus fixing the head 101 to the U-shaped flexible handle, as shown more clearly in FIG. 10.

Figure 10:
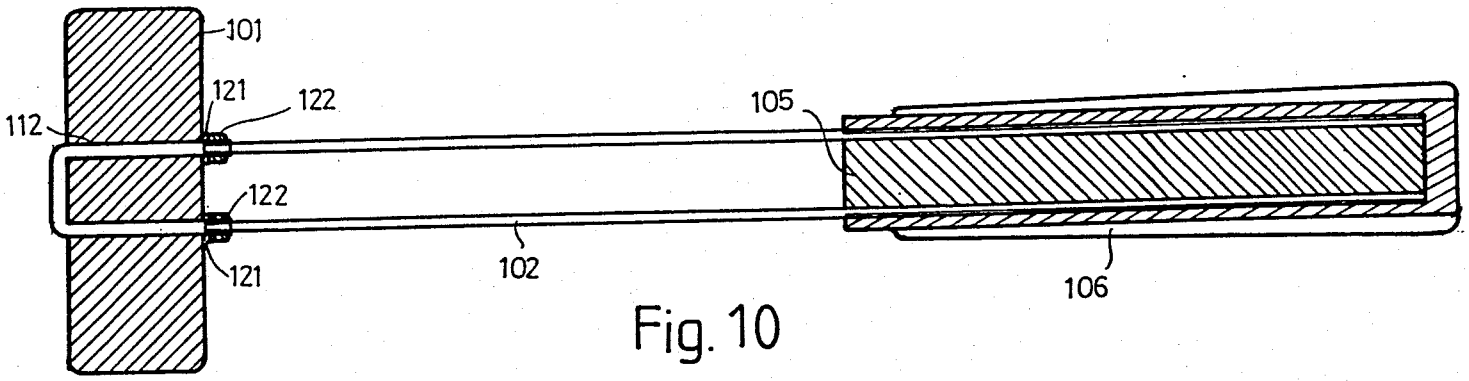
FIG. 10 is a longitudinal sectional view thereof.

As shown in FIGS. 9 and 10, two 1 round slots 151 are provided on the rim of the clamp post 105, substantially diametrically opposed to one another. The diameter of the cross section of the round slots 151 is substantially the same as that of the cross section of the U-shaped flexible handle 102. After the U-shaped flexible handle 102 penetrates through and stays in the round slots 151, it forms a complete circle together with the clamp post 105. Further threads are provided in a proper length on the post face of the clamp post 105. The inner threads of the precast, formed hand grip 106 directly screw on and match the clamp post 105, thereby securing the open ends of the U-shaped flexible handle 102.

Figure 12:
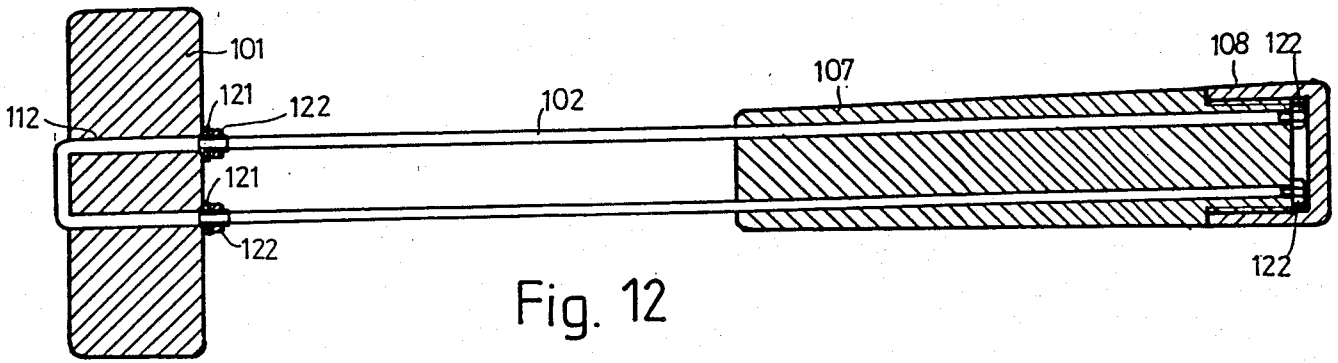
FIG. 12 is a longitudinal sectional view thereof.
Figure 11:
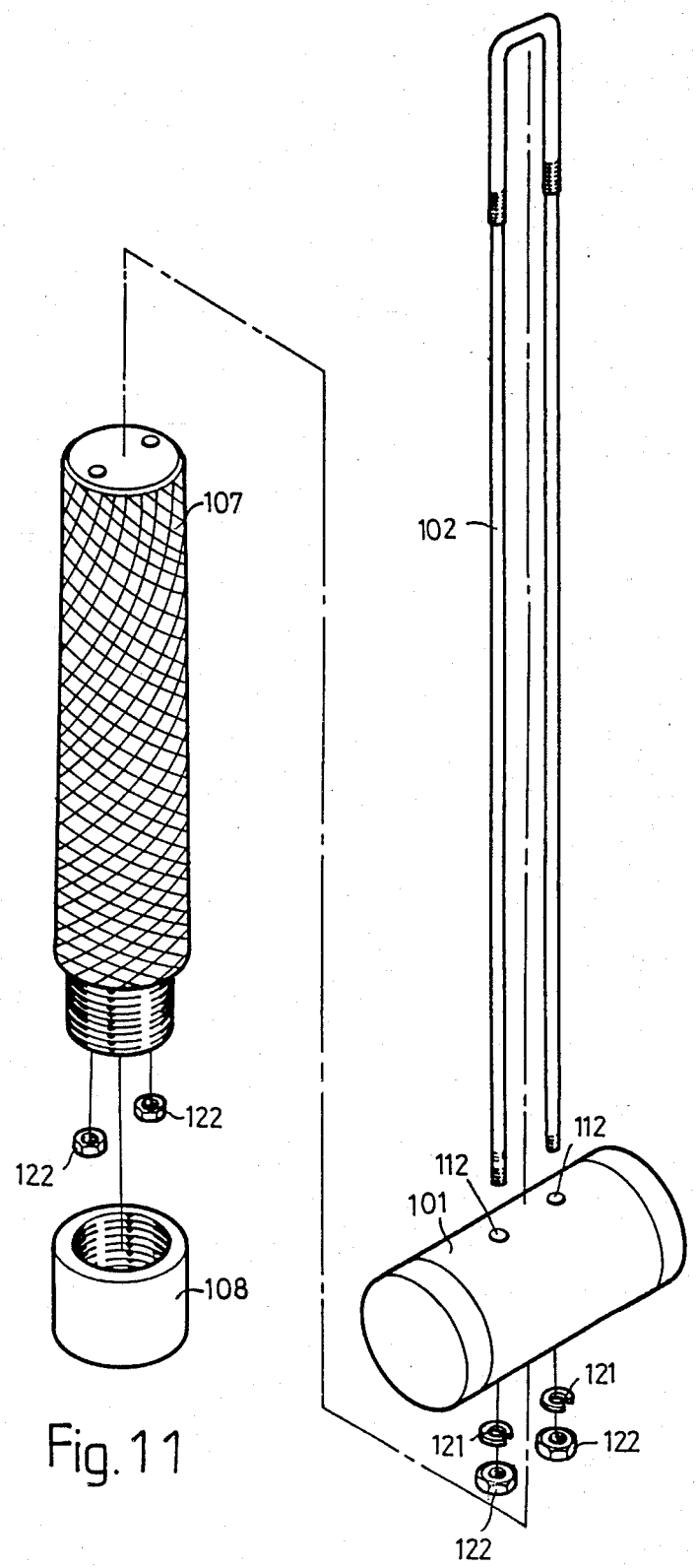
FIG. 11 is an exploded perspective of yet another embodiment of the present invention.

As shown in FIGS. 11 and 12, there is illustrated a hammer block 101, U-shaped flexible handle 102, sleeve post 107 and rear cover 108. The hammer block 101 and the U-shaped flexible handle 102 are joined and locked (in a similar manner as in FIG. 9). The open ends of the U-shaped flexible handle 102 penetrate through the cylindrically-shaped sleeve post 107, and their protruding ends are fixed by respective second nuts 122. The outer diameter of a proper length of the tail end (or lower end) of the sleeve post 107 is smaller and is provided with external threads. These external threads match an internally-threaded rear cover or locking collar 108, thus tightly covering and securing the nuts 122 on the lower end of the sleeve post as shown more clearly in FIG. 12, thereby substantially avoiding any free sliding movement between the sleeve post 107 and the U-shaped flexible handle 102.

Figure 13:
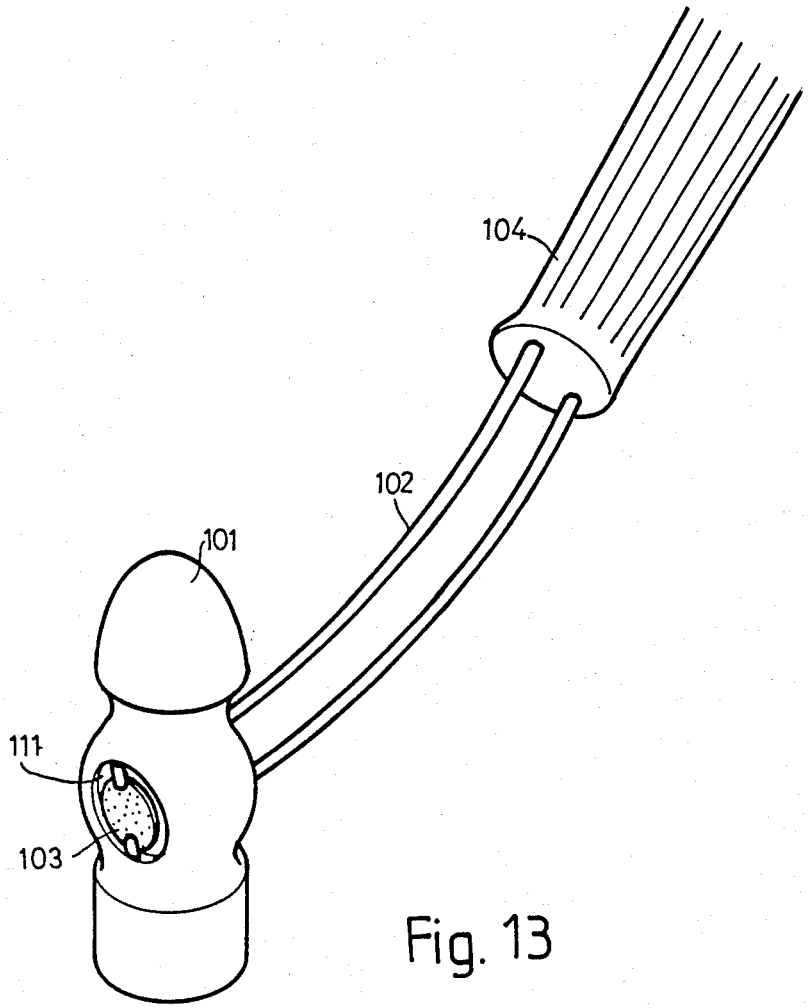
FIG. 13 illustrates the use of one embodiment of the present invention.

The hammer tool structures of the above-noted embodiments of the present invention all use a U-shaped flexible handle as an integral part of the hammering tool. The flexibility and proper rigid strength of this U-shaped flexible handle facilitates the improved performance of the hammer tool of the present invention. During its operation, flexible deformations eliminate the counter-vibrations to the user, as shown in FIG. 13.

In summary, the structure of the hammering tool with its unique flexible handle according to this invention is simple, economical to manufacture, reliable in its performance, and prevents the hammering block or head from sliding back. Moreover, the variety of different cross sectional forms on the longitudinal ribs provided on the middle section of the plate springs provide the desired stiffness consonant with flexibility.

I claim:

1. In a hammering tool having a gripping handle and further having a head portion for delivering impact blows, the improvement which comprises a pair of substantially parallel members having respective first and second end portions, means for securing the first respective end portion to the gripping handle, and means for anchoring the second respective end portion to the head portion of the tool, wherein the members may flex substantially in unison as the tool is used to deliver the impact blows, wherein the members comprise substantially parallel plate-like springs, each of which is provided with a longitudinal rib extending substantially from the head to the handle, and wherein the means to anchor the second respective end portions of the springs comprises the head having a tapered cross bore formed therein, the tapered bore diverging downwardly of the head and in a direction towards the handle, and a wedge block received in the bore and having a complementary taper to anchor the plate-like springs in the head.

2. In a hammering tool having a gripping handle and further having a head portion for delivering impact blows, the improvement which comprises a pair of substantially parallel members having respective first and second end portions, means for securing the first respective end portion to the gripping handle, and means for anchoring the second respective end portion to the head portion of the tool, wherein the members may flex substantially in unison as the tool is used to deliver the impact blows, wherein the members comprise substantially parallel plate-like springs, and wherein the means to anchor the second respective end portions of the springs comprises the head having a tapered cross bore formed therein, the tapered bore diverging downwardly of the head and in a direction towards the handle, and a wedge block received in the bore and having a complementary taper to anchor the plate-like springs in the head, wherein the second respective portions of the plate-like springs have intermediate portions provided with respective outwardly-protruding ears, and wherein the wedge block has an end portion extending below the head and engaging the respective outwardly-protruding ears of the plate-like springs, thereby preventing the wedge block from slipping out of the head.

3. The improvement of claim 1, wherein the parallel members have respective extremities protruding through the wedge block and provided with respective substantially right-angularly bent tabs, and wherein the head is provided with a bore for receiving the members and is further provided with a communicating counterbore for receiving the respective tabs, thereby further anchoring the parallel members in the head.

4. A hammer tool, comprising a hammer block having a pair of substantially parallel through holes formed therein transversely thereof, a U-shaped flexible handle having a bight portion and further having a pair of substantially parallel legs integrally formed therewith, the legs being inserted within the respective holes in the hammer block, first threads formed on an intermediate portion of each leg and extending just beyond the hammer block, first nuts cooperating with the first threads, respectively, thereby securing the flexible handle to the hammer block, a sleeve having a pair of longitudinal through holes formed therein for receiving the respective legs of the flexible handle, the legs having respective end portions, second threads formed on the respective end portions of the legs, second nuts carried by the second threads, respectively, the sleeve having a lowermost portion provided with external threads, and an internally-threaded locking collar secured to the external threads on the sleeve and bearing against the second nuts.

5. The hammer tool of claim 4, wherein the hammer block is substantially cylindrical.

6. The hammer block of claim 4, wherein the sleeve is substantially cylindrical and has an outer surface which is knurled, thereby providing a hand grip.

7. A hammer, comprising a gripping handle, a pair of substantially-parallel relatively-thin spring plates secured to the handle and extending therefrom, each of the plates having respective end portions, a hammering head having a transverse opening formed therein and receiving the end portions of the respective plates, each of the end portions of the plates having an outwardly-bent tab formed thereon and engaging the head adjacent to the opening therein, a wedge received between the end portions of the plates in the opening in the head, thereby securing the head to the plates, and each of the plates having an intermediate portion between the head and the handle formed with a longitudinal rib for strengthening purposes.

8. The hammer of claim 7, wherein each of the longitudinal ribs has a cross-section including an outwardly-extending curved portion.

9. The hammer of claim 7, wherein the opening in the head is tapered and diverges outwardly towards the handle, and wherein the wedge has a taper complementary to the tapered opening in the head.

10. A hammer, comprising a gripping handle, a pair of substantially-parallel relatively-thin spring plates secured to the handle and extending therefrom, each of the plates having respective end portions, a hammering head having a transverse opening formed therein and receiving the end portions of the respective plates, the opening being tapered and diverging outwardly towards the handle, each of the end portions of the plates having an outwardly-bent tab formed thereon and engaging the head adjacent to the opening therein, a wedge received between the end portions of the plates in the opening in the head, the wedge having a taper complementary to the tapered opening in the head, thereby securing the head to the plates, and each of the plates having an intermediate portion between the head and the handle formed with a longitudinal rib for strengthening purposes, each of the longitudinal ribs having a cross-section including an outwardly-extending curved portion.

* * * * *